US006007471A

United States Patent [19]

Munk et al.

[11] Patent Number: 6,007,471

[45] Date of Patent: Dec. 28, 1999

[54] FLATTENING DEVICE IN A PAPER PROCESSING MACHINE

[75] Inventors: Werner Munk, Schwabmünchen; Christian Kraus, Aystetten; Helmut Koelle, Augsburg, all of Germany

[73] Assignee: Boewe Systec AG, Augsburg, Germany

[21] Appl. No.: 08/894,721

[22] PCT Filed: Dec. 21, 1995

[86] PCT No.: PCT/DE95/01859

§ 371 Date: Aug. 8, 1997

§ 102(e) Date: Aug. 8, 1997

[87] PCT Pub. No.: WO96/26145

PCT Pub. Date: Aug. 29, 1996

[30] Foreign Application Priority Data

Feb. 24, 1995 [DE] Germany ..... 195 06 465

[51] Int. Cl.[6] ..... B31F 1/00

[52] U.S. Cl. ..... 493/461; 493/459; 242/90; 242/180

[58] Field of Search ..... 493/459, 461; 162/271, 270; 242/419, 615, 615.2; 226/118.2, 90, 180

[56] References Cited

U.S. PATENT DOCUMENTS

| | | | |
|---|---|---|---|
| 1,935,726 | 11/1933 | Pierson | 242/419 |
| 3,051,362 | 8/1962 | Shook | 226/118.2 |
| 3,656,677 | 4/1972 | Stepanek et al. | 226/180 |
| 4,360,356 | 11/1982 | Hall | 493/459 |
| 5,009,749 | 4/1991 | Cederholm et al. | 162/271 |
| 5,193,728 | 3/1993 | Pieroni | 226/90 |
| 5,346,457 | 9/1994 | Kimura | 493/459 |
| 5,848,347 | 12/1998 | Kuo et al. | 162/271 |

FOREIGN PATENT DOCUMENTS 4314672 11/1994 Germany .

OTHER PUBLICATIONS

Konica Co., Transfer Paper Curl Eliminator for Transfer Type Image Former, Patnet Abstracts of Japan, Mar. 1989.

*Primary Examiner*—Peter Vo
*Assistant Examiner*—Matthew Luby
*Attorney, Agent, or Firm*—Flynn, Thiel, Boutell & Tanis, P.C.

[57] ABSTRACT

A curl-suppressing device for a paper web in a paper processing machine has a stationary deflecting bar (1) that extends transversely to the direction of travel (A) of the paper, a deflecting roller (4) parallel to the deflecting bar (1) and arranged downstream of the deflecting bar (1) in the direction of travel of the paper and two supporting plates (3) that carry the ends of the deflecting bar and deflecting roller and may be displaced around a swivelling axis (A3) on a stationary support (9). The paper web (2) to be decurled runs in a S-shaped path between the deflecting bar (1) and the deflecting roller (4) and is frictionally drawn over the deflecting bar (1). A regulating motor is associated to one of the supporting plates (3) to swivel the supporting plate (3) until at least the deflecting bar (1) may be moved out of contact with the paper web (2).

9 Claims, 4 Drawing Sheets

8
4
7
A3
6
1
9
5
3

B
G1
4
9
A3
3
1
G2
4
A
2
3
A3
1
9

G1
G2
C
1
3
A3
4
9
2
A3
1
9

FLATTENING DEVICE IN A PAPER PROCESSING MACHINE

FIELD OF THE INVENTION

This invention relates to a flattening device for a paper web in a paper processing machine, with a non-rotatable deflecting bar extending transversely to the paper feed direction, a deflecting roller parallel thereto and preceding or following the bar in the paper feed direction and two support plates carrying in common the respective ends of the deflecting bar and of the deflecting roller, which plates are adjustable relative to a stationary mount about a pivotal axis arranged between and axially parallel to the axes of the deflecting bar and the deflecting roller, wherein the paper web passes in an S-shape between the deflecting bar and the deflecting roller for the flattening and is drawn under friction over the deflecting bar.

BACKGROUND OF THE INVENTION

If for example a paper processing installation is arranged after a laser printer in an automatic account processing machine, it frequently happens that the paper web leaving the laser printer has curvatures, so-called curls. These curvatures stem from the fact that the paper web is heated in the laser printer, whereby the residual moisture of the paper web is reduced. Since this heating takes place on one side, the paper curves and holds its curvature even during further passage through the paper processing machine. Since the curvature exhibits itself by interfering with the further processing it is advantageous to cancel it out by a flattening device of the kind initially referred to. However, further problems can arise from the flattening device itself. In the known flattening device, the adjustability of the support plates about their axis merely serves to alter the wrap angle with which the paper web surrounds the stationary deflecting bar, in order to thereby remove curvatures of the paper web of different degrees. The appropriate position of the deflecting bar and the deflecting roller relative to one another is determined in a trial run and then the support plates are clamped in position relative to the mount. Therefore, the deflecting bar and the deflecting roller always assume the same position, both when the paper web is running and also when it is stationary, during further operation of the machine. The disadvantage which arises from this is that the friction with the deflecting bar has to be overcome also when starting the machine. In order to avoid the paper web tearing, the starting up has to take place slowly. Also, the fact that the paper web bears in S-shape on the deflecting bar and the deflecting roller while the machine is stationary has a disturbing effect. Because of this an S-shaped deformation forms in the paper web, which can also lead to disturbance in further processing. At the least, the S-shaped deformation remains visible after the processing. Finally the curvatures of the paper web caused by the laser printer can be differently orientated. Since, however, this can only be determined after a trial run of the machine, it is frequently necessary to un-thread the paper web again from the flattening device (also called a de-curler), so that the deflecting bar and deflecting roller can be turned into a position, after releasing the clamping arrangement, in which the cancellation of an oppositely directed curvature of the paper web is possible. Then the paper web has to be threaded up again, which is time-consuming, because this does not have to take place only in the de-curler but also in further stations of the machine.

The invention is therefore based on the object of providing a flattening device for a paper web in a paper processing machine, in which S-shaped deformations of the paper web while the machine is stationary are avoided. In further development of the invention the flattening device is to be so designed that it facilitates the cancellation also of oppositely directed curvatures which are caused by the laser printer, without threading up the paper web again.

As to the first-mentioned purpose, the invention firstly provides that a servomotor is associated with one of the support plates, by means of which the support plate can be turned so far that at least the deflecting bar can be brought out of contact with the paper web.

With this novel design it is possible to avoid S-shaped deformations while the machine is stationary. Thus, each time the machine stops, the motor-driven support plate is automatically turned into a position in which at least the deflecting bar, but preferably the deflecting roller also, no longer bears on is the paper web. The flattening device is thus inactive and no S-shaped deformations can form while the machine is stationary. Also, when starting the machine, the flattening device initially remains in its inactive position. This has the advantage that no friction occurs between the paper web and the deflecting bar during starting, so that start-up can take place more rapidly. Only when the initial phase has passed is the flattening device rendered active again by motorised turning of the support plate. During the starting phase, no flattening is necessary, since the flattening device is arranged a long way from the laser printer and some time elapses before the paper web section curved in the laser printer while the machine is stationary reaches the flattening device. The flattening device can inter alia also be operated so that it is only activated when a paper section curved in the laser printer while the machine is stationary passes directly through the flattening device. For the rest of the time the flattening device remains inactive, so that wear on the smoothing device is avoided.

A particularly advantageous design of the flattening device consists in that two like flattening devices are arranged one after the other in the paper feed direction, whose support plates are adjustable about their pivotal axes by respective servo-motors so that their deflecting bars are arranged in the inactive state on opposite sides of the paper web at a distance therefrom If the paper web is threaded up in this inactive state of the flattening device between its deflecting bars and deflecting rollers, one or the other of the flattening devices can be activated after starting the machine, depending on the direction in which the paper web is curved by the laser printer while the machine is stationary.

BRIEF DESCRIPTION OF THE DRAWINGS

The invention will be explained in more detail below, with reference to two embodiments shown in the drawings, in which.

DETAILED DESCRIPTION

Figure 3:
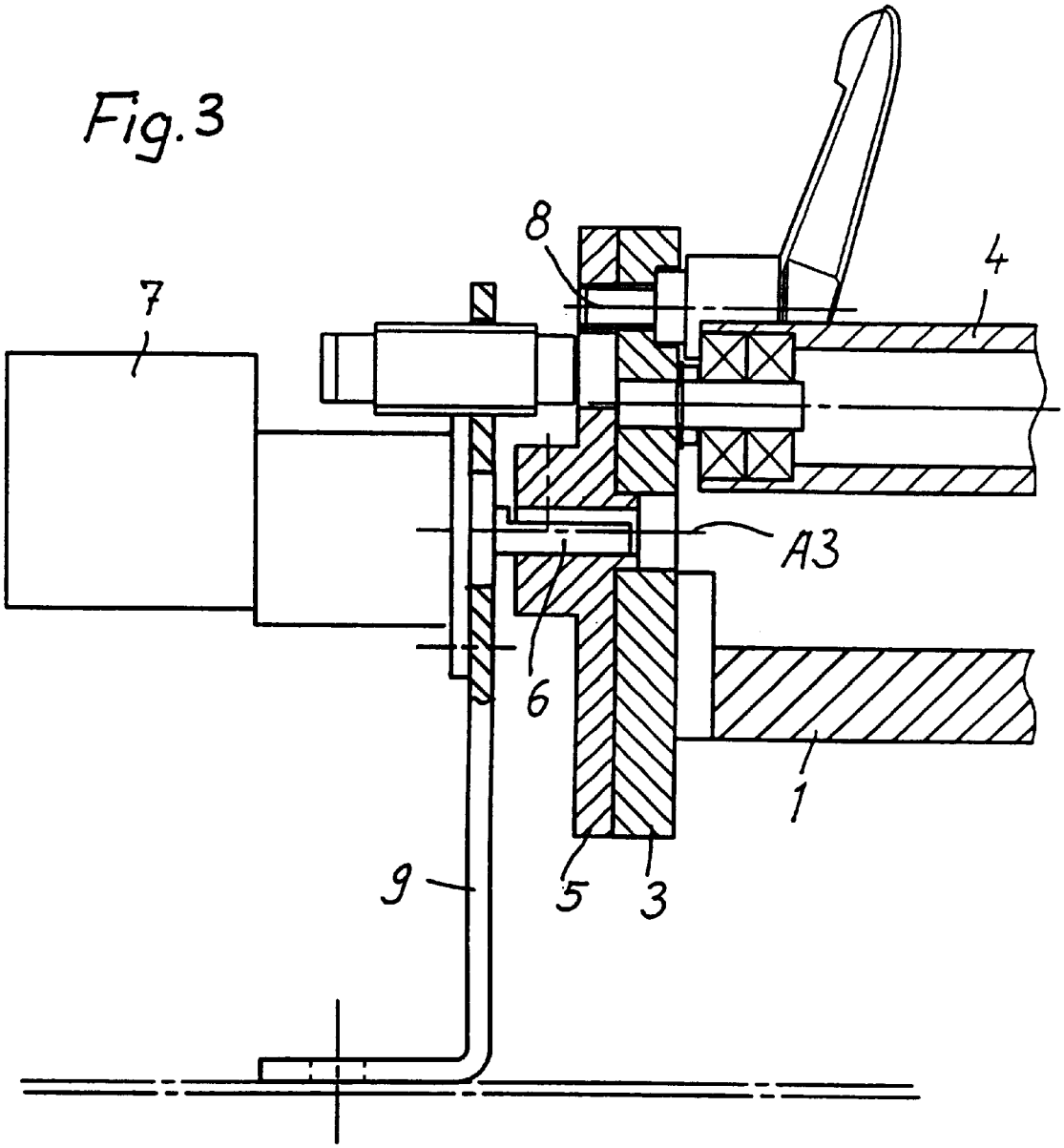
FIG. 3 is a partial cross-section on the line III—III of FIG. 1.

The stationary deflecting bar 1, which extends transversely relative to the feed direction A of the paper web 2 is fixed at its two ends to respective support plates 3. The stationary deflecting bar 1 has a relatively small deflecting radius R of 5 mm for example, or if desired even one or more deflecting edges. A deflecting roller 4 of greater diameter is also mounted rotatably on the same two support plates 3, with its axis A2 parallel to the axis A1 of the deflecting bar 1. The support plate 3 lies on an intermediate plate 5, as can be seen in FIG. 3. This intermediate plate 5 is connected rotationally fast to a drive shaft 6, which can be driven by a servomotor 7. Since the drive shaft 6 only has to turn through a relatively small pivotal range of about 90°, not only can an electric motor with gears be used as the servomotor but also a rotary solenoid or a piston and cylinder unit for example. In addition to this motorised adjustment by means of the servomotor, the support plate 3 can be adjusted within limits relative to the intermediate plate 5 about a pivotal axis A3 formed by the drive shaft 6 and be clamped in position. Two clamping screws 8 are provided for clamping the support plate 3 relative to the intermediate plate 5, only one of which is shown in the drawings. By loosening these clamping screws 8 and turning the support plate 3 relative to the intermediate plate 5, the wrap angle with which the paper web surrounds the deflecting bar 1 according to FIG. 1 can be altered. It is possible by this to flatten curvatures of the paper web of different degrees by the flattening device. A servomotor with the described intermediate plate 5 only needs to be provided for one of the support plates 3. The other support plate, not shown, can be mounted rotatably directly in a mount, which corresponds to the mount 9 shown in FIG. 3.

Figure 1:
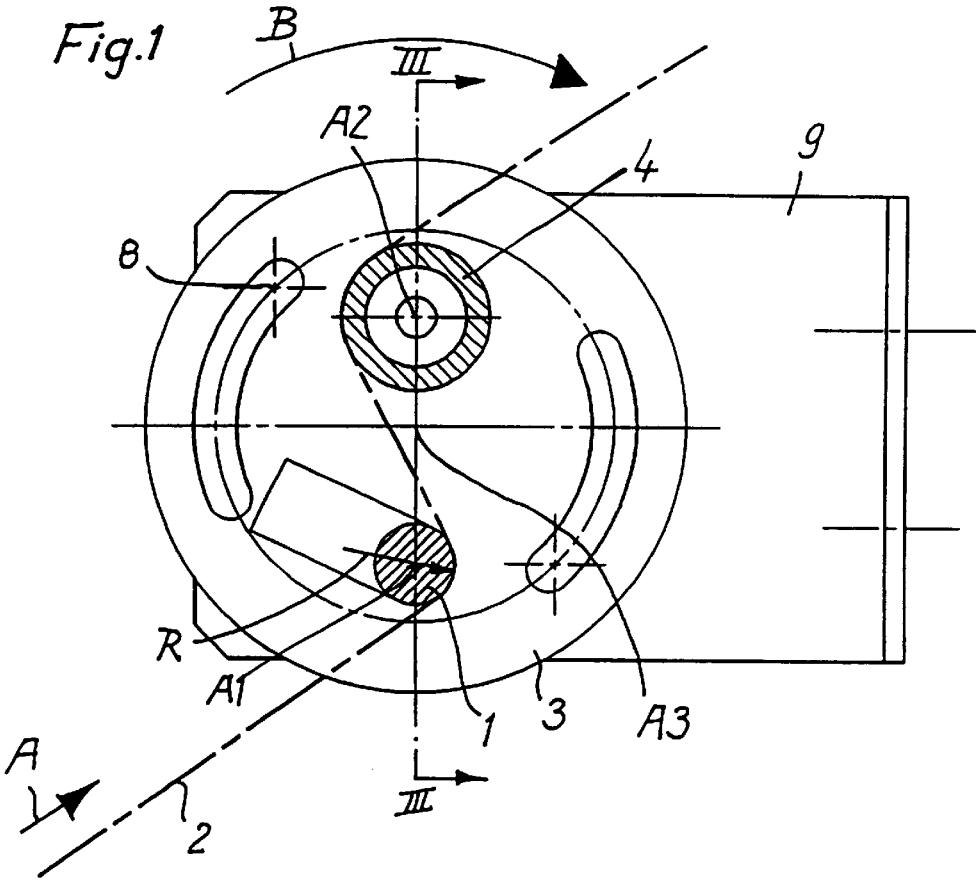
FIG. 1 is a longitudinal section of the flattening device in active state.

FIG. 1 shows the flattening device in the active state. The paper web 2 coming from a laser printer, not shown, is fed for flattening in a S-shape between the deflecting bar 1 and the deflecting roller 4. It is pulled under friction over the deflecting bar 1, whereby a curvature of the paper web which arose from one-sided heating in the laser printer is cancelled again.

Figure 2:
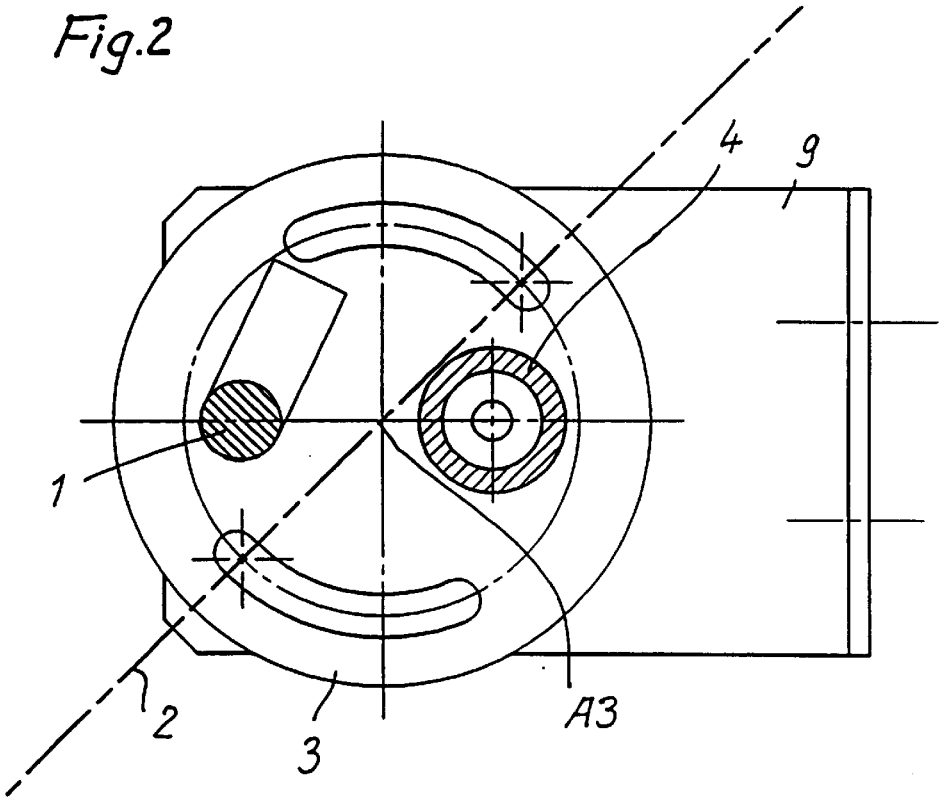
FIG. 2 is a longitudinal section in the inactive state.

In order that no S-shaped deformation shall occur in the paper web while the machine is stationary, the flattening device is rendered inactive while the machine is stationary. This is effected in that the intermediate plate 5 is turned together with the support plate 3 by means of the servomotor 7 out of its active position, in the direction B into its inactive position shown in FIG. 2. In this position the stationary deflecting bar 1 is spaced from the paper web 2 and the deflecting roller 4 also does not touch the paper web. The inactive position of the flattening device is also maintained briefly when starting up the machine.

Figure 4:
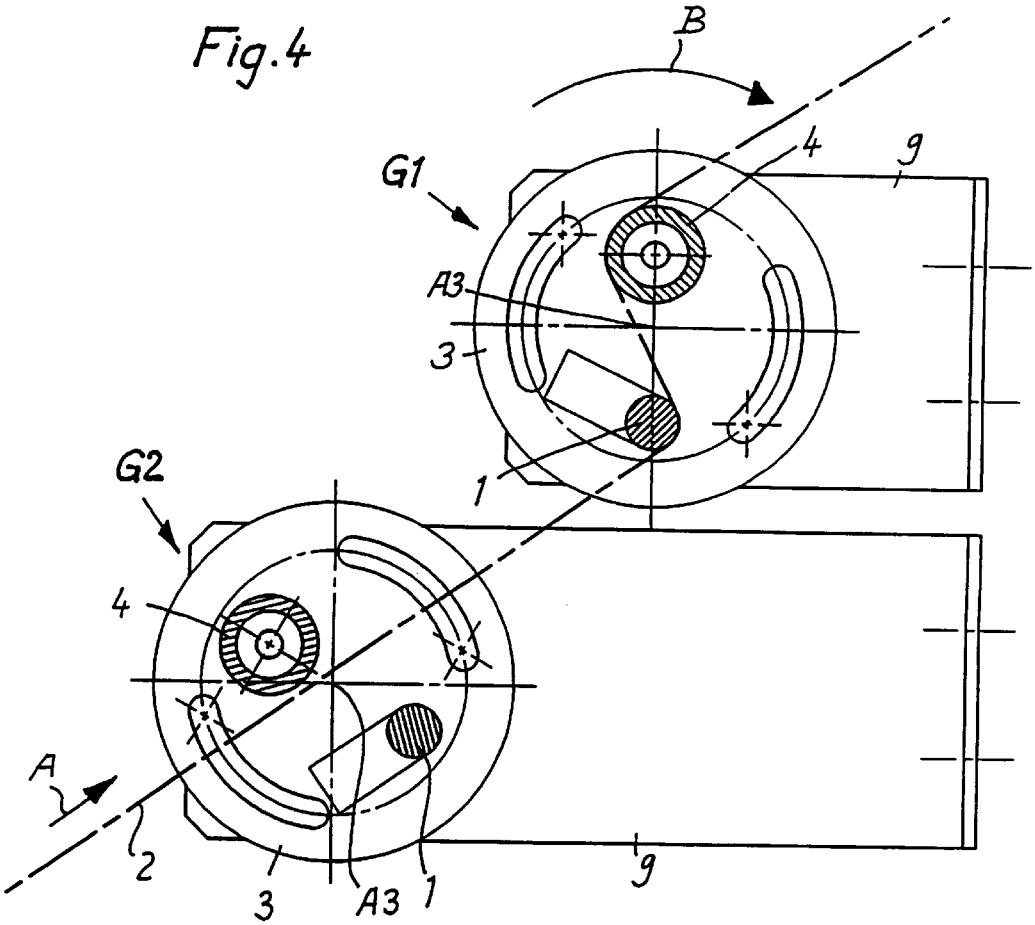
FIG. 4 is a longitudinal section of an especially advantageous embodiment with two like flattening devices arranged one after the other.
Figure 5:
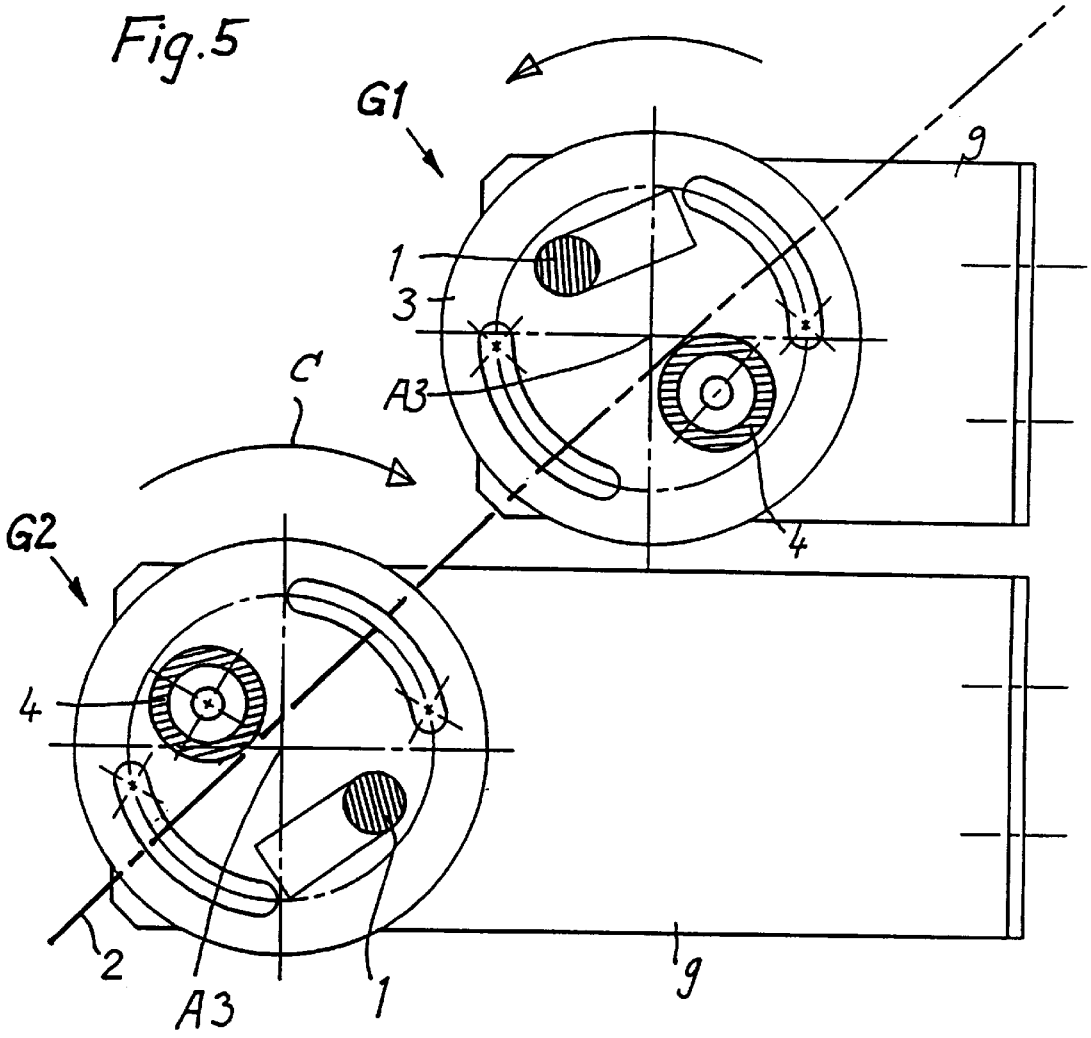
FIG. 5 is a longitudinal section of this embodiment in the inactive state.

A particularly advantageous embodiment of the invention is shown in FIG. 4. Two like flattening devices G1 and G2 are arranged one after the other in the paper feed direction A. The design of each of these two flattening devices G1 and G2 corresponds to the design described above with reference to FIGS. 1 to 3. An individual servomotor is associated with each of the two flattening devices G1 and G2. The support plates 3 of the two flattening devices G1 and G2 are connected to their intermediate plates 5 turned through 180° relative to one another. Moreover, the servomotors for activating the respective flattening devices are driven in opposite directions to one another. The result of this is that the deflecting bars 1 of the two flattening devices are arranged spaced from opposite sides of the paper web in the non-activated state, as is shown in FIG. 5. While the machine is stationary and when starting up the machine, both flattening devices G1 and G2 are in the positions shown in FIG. 5. The paper web 2 can pass freely through the two flattening devices G1 and G2. When it is found in the trial run that a curvature occurs in the laser printer which can be cancelled out by the flattening device G1, then this flattening device is activated according to FIG. 4, as is shown in FIG. 4. If, on the contrary, the paper web gets an oppositely directed curvature in the laser printer, the other flattening device G2 is activated, in that its support plate is turned in the direction of the arrow C according to FIG. 4, while the support plate of the flattening device G1 is rendered inactive by turning its support plate 3 in the direction of the arrow B. Thus, one or the other flattening device can be used during operation of the machine, without having to thread up the paper web again.

We claim:

1. A flattening device for decurling a paper web traveling in a feed direction in a paper processing machine, the paper web having opposite first and second sides, comprising: spaced apart first and second support plates; an elongate paper-deflecting bar extending transversely to the paper feed direction and adjacent the first side of the paper web, said bar being fixed to said first and second support plates, said bar defining a first axis abut which said bar is non-rotatable; an elongate paper-deflecting roller extending parallel to said bar and rotatable secured to said first and second support plates, said roller defining a second axis and being spaced from said bar adjacent the second side of the paper web; a stationary mount pivotally supporting said first and second support plates about a pivot axis extending between and parallel to said first and second axes, and a servomotor connected to one of said support plates for pivoting said support plates, bar and roller about said pivot axis between a paper decurling active position and an inactive position, said bar frictionally contacting the first side of the paper web and said roller rotationally contacting the second side of paper web in said active position so that the paper web travels in a S-shaped path in the feed direction and is decurled, and at least said bar is free of contact with the paper web in said inactive position.

2. A device according to claim 1, wherein said pivot axis is positioned in a plane containing said first and second axes.

3. A device according to claim 1, wherein an intermediate plate connects said servomotor to said one of said support plate, said one of said support plate is adjustably mounted to said intermediate plate in order to adjust the position of said pivot axis, and once the position of said pivot axis is adjusted, a clamp device clamps said one of said support plate in position on said intermediate plate.

4. A device according to claim 3, wherein said clamp device includes a clamping screw for clamping said one of said support plate in position on said intermediate plate.

5. A device according to claim 2, wherein an intermediate plate connects said servomotor to said one of said support plate, said one of said support plate is adjustably mounted to said intermediate plate in order to adjust the position of said pivot axis, and once the position of said pivot axis is adjusted, a clamp device clamps said one of said support plate in position on said intermediate plate.

6. A device according to claim 5, wherein said clamp device includes a clamping screw for clamping said one of said support plate in position on said intermediate plate.

7. A device according to claim 1, wherein said bar precedes said roller in the paper feeding direction so that said bar contacts the paper web prior to said roller contacting the paper web in said active position.

8. A device according to claim 1, wherein, in said inactive position, said roller is free of contact with the paper web.

9. A flattening system for decurling a paper web in a traveling direction in a paper processing machine, the paper web having opposite first and second sides, comprising:

two like flattening devices each comprising:

spaced apart first and second support plates, an elongate paper-deflecting bar extending transversely to the paper feed direction and fixed to said first and second support plates, said bar being adjacent the first side of the paper web and defining a first axis about which said bar is non-rotatable; an elongate paper-deflecting roller extending parallel to said bar and rotatably secured to said first and second support plates, said roller being adjacent the second side of the paper web and defining a second axis; a stationary mount pivotally supporting said first and second support plates about a pivot axis extending between and parallel to said first and second axes, and a servomotor connected to one of said first and second support plates for pivoting said support plates between a paper decurling active position and an inactive position, said bar nonrotatably frictionally contacting the first side of the paper web and said roller rotationally contacting the second side of the paper web in said active position so that the paper web travels in a S-shape path in the traveling direction and is decurled, and at least said bar is free from the paper web in the inactive position; and said two flattening devices being positioned one after the other in the paper feed direction, said first support plates of said two flattening devices being separately adjustable about respective said pivot axes by respective said servomotors so that the respective said deflecting bars fixed to said support plates are arranged in their respective said inactive position on opposite sides of the paper web at a distance from each other.

* * * * *